US008154478B2

(12) United States Patent
Park et al.

(10) Patent No.: US 8,154,478 B2
(45) Date of Patent: Apr. 10, 2012

(54) ORGANIC ELECTRO LUMINESCENCE DISPLAY AND DRIVING METHOD THEREOF

(75) Inventors: Young-jong Park, Suwon-si (KR); Jong-soo Kim, Suwon-si (KR)

(73) Assignee: Samsung Mobile Display Co., Ltd., Giheung-Gu, Yongin, Gyunggi-Do (KR)

( * ) Notice: Subject to any disclaimer, the term of this patent is extended or adjusted under 35 U.S.C. 154(b) by 1233 days.

(21) Appl. No.: 11/902,649

(22) Filed: Sep. 24, 2007

(65) Prior Publication Data

US 2008/0204378 A1 Aug. 28, 2008

(30) Foreign Application Priority Data

Feb. 23, 2007 (KR) ..... 10-2007-0018657

(51) Int. Cl.
*G09G 3/30* (2006.01)

(52) U.S. Cl. ..... 345/76; 345/45; 345/82; 345/100; 345/204; 315/169.3

(58) Field of Classification Search ..... 345/76–100, 345/204, 207, 690; 315/169.1–169.3
See application file for complete search history.

(56) References Cited

U.S. PATENT DOCUMENTS

| | | | | |
|---|---|---|---|---|
| 5,754,150 | A | 5/1998 | Matsui | |
| 7,369,183 | B2 | 5/2008 | Oka et al. | |
| 7,505,026 | B2 * | 3/2009 | Baba et al. | 345/102 |
| 7,656,383 | B2 | 2/2010 | Hedrick | |
| 7,679,602 | B2 | 3/2010 | Owyeung et al. | |
| 7,724,247 | B2 * | 5/2010 | Yamazaki et al. | 345/207 |
| 7,746,317 | B2 | 6/2010 | Fu et al. | |
| 7,782,279 | B2 | 8/2010 | Lee et al. | |
| 7,839,091 | B2 | 11/2010 | Kohashikawa et al. | |
| 2002/0011978 | A1 * | 1/2002 | Yamazaki et al. | 345/87 |
| 2004/0041928 | A1 | 3/2004 | Hirakoso et al. | |
| 2005/0057191 | A1 | 3/2005 | Jo et al. | |

(Continued)

FOREIGN PATENT DOCUMENTS

JP 2000-221944 8/2000

(Continued)

OTHER PUBLICATIONS

*Office Action* from the KIPO issued in Applicant's corresponding Korean Patent Application No. 10-2007-0018657 dated Mar. 27, 2008.

(Continued)

*Primary Examiner* — Quan-Zhen Wang
*Assistant Examiner* — Jennifer Nguyen
(74) *Attorney, Agent, or Firm* — Robert E. Bushnell, Esq.

(57) ABSTRACT

An organic electro luminescence display and driving method uses an image determination unit to generate image determination signals indicative of whether images generated in response to data signals are moving images still images, selects a gamma value corresponding to the brightness of the ambient light sensed, applies gamma correction signals corresponding to selected gamma values to control grey level voltages of the data signals, generates a selection signal based on a comparison of a previously set reference value with the photo sensor signal, and generates R',G',B' data to vary an input image RGB data to correspond to the selection signal, varies a change range of the changing R',G',B' data to correspond to the image determination signal, and supplies the varied change range of the changing data (R',G',B' data) to the data driver.

10 Claims, 7 Drawing Sheets

U.S. PATENT DOCUMENTS

| | | | | |
|---|---|---|---|---|
| 2005/0253835 | A1 | 11/2005 | Kawase | |
| 2006/0001624 | A1 | 1/2006 | Lee | |
| 2006/0114205 | A1 | 6/2006 | Shen et al. | |
| 2006/0244387 | A1 | 11/2006 | Park et al. | |
| 2007/0146302 | A1 | 6/2007 | Liu et al. | |
| 2008/0186262 | A1* | 8/2008 | Lee | 345/82 |
| 2008/0186263 | A1* | 8/2008 | Lee | 345/82 |
| 2008/0186264 | A1* | 8/2008 | Lee | 345/82 |
| 2008/0204438 | A1 | 8/2008 | Song et al. | |
| 2008/0246699 | A1 | 10/2008 | Oh | |
| 2009/0166510 | A1 | 7/2009 | Park et al. | |

FOREIGN PATENT DOCUMENTS

| | | |
|---|---|---|
| JP | 2001-134255 | 5/2001 |
| JP | 2005-308857 | 11/2005 |
| JP | 2007-025317 | 2/2007 |
| KR | 10-1990-0003762 | 3/1990 |
| KR | 1992-0004293 | 6/1992 |
| KR | 1999-0030441 | 7/1999 |
| KR | 10-2000-0033177 | 6/2000 |
| KR | 10-2004-0015910 | 2/2004 |
| KR | 10-2005-0099303 | 10/2005 |
| KR | 10-2006-0010912 | 2/2006 |
| KR | 10-2006-0012738 | 2/2006 |
| KR | 10-2006-0035831 | 4/2006 |
| KR | 10-2006-0078590 | 7/2006 |
| KR | 10-2006-0079573 | 7/2006 |
| KR | 10-0629587 | 9/2006 |
| KR | 10-2006-0112997 | 11/2006 |
| KR | 10-2006-0113009 | 11/2006 |
| KR | 10-2006-0120643 | 11/2006 |

OTHER PUBLICATIONS

U.S. Notice of Allowance dated Feb. 7, 2011 for U.S. Appl. No. 11/861,107 which cross-referenced with U.S. Appl. No. 11/861,112.

U.S. Notice of Allowance dated Feb. 8, 2011 for U.S. Appl. No. 11/861,109 which cross-referenced with U.S. Appl. No. 11/861,112.

U.S. Office action dated Sep. 1, 2010 for U.S. Appl. No. 11/861,107 which is related to U.S. Appl. No. 11/861,112.

U.S. Office action dated Sep. 16, 2010 for U.S. Appl. No. 11/861,109 which is related to U.S. Appl. No. 11/861,112.

U.S. Office action dated Sep. 16, 2010 for U.S. Appl. No. 11/861,128 which is related to U.S. Appl. No. 11/861,112.

* cited by examiner

FIG. 7A $$A\begin{bmatrix} R_{in} \\ G_{in} \\ B_{in} \end{bmatrix} = \begin{bmatrix} R_s \\ G_s \\ B_s \end{bmatrix}$$

FIG. 7B $$A = \begin{bmatrix} 0.299+0.701\times k & 0.587\times(1-k) & 0.114\times(1-k) \\ 0.299\times(1-k) & 0.587+0.413\times k & 0.114\times(1-k) \\ 0.299\times(1-k) & 0.587\times(1-k) & 0.114+0.886\times k \end{bmatrix}$$

FIG. 7C $$\begin{bmatrix} 0.299+0.701\times k & 0.587\times(1-k) & 0.114\times(1-k) \\ 0.299\times(1-k) & 0.587+0.413\times k & 0.114\times(1-k) \\ 0.299\times(1-k) & 0.587\times(1-k) & 0.114+0.886\times k \end{bmatrix}\begin{bmatrix} R_{in} \\ G_{in} \\ B_{in} \end{bmatrix} = \begin{bmatrix} R_s \\ G_s \\ B_s \end{bmatrix}$$

FIG. 7D $$\begin{bmatrix} 0.299 & 0.587 & 0.114 \\ 0.299 & 0.587 & 0.114 \\ 0.299 & 0.587 & 0.114 \end{bmatrix}\begin{bmatrix} R_{in} \\ G_{in} \\ B_{in} \end{bmatrix} = \begin{bmatrix} R_s \\ G_s \\ B_s \end{bmatrix}$$

ORGANIC ELECTRO LUMINESCENCE DISPLAY AND DRIVING METHOD THEREOF

CLAIM OF PRIORITY

This application makes reference to, incorporates the same herein, and claims all benefits accruing under 35 U.S.C. §119 from an application for ORGANIC LUMINESCENCE DISPLAY AND DRIVING METHOD THEREOF earlier filed in the Korean Intellectual Property Office on the 2 Jan. 2007 and there duly assigned Serial No. 10-2007-0018657.

BACKGROUND OF THE INVENTION

1. Field of the Invention

The present invention relates to an organic electro luminescence display, and more particularly to a control unit and a process capable of reducing power consumption and/or improving an outdoor, and an organic electro luminescence display including the control unit.

2. Description of the Related Art

In recent years, there have been may attempts to develop various flat panel displays capable of reducing a weight and volume of a cathode ray tube, which are problematic for cathode ray tubes. The flat panel display includes a liquid crystal display, a field emission display, a plasma display panel, an organic electro luminescence display, and other devices able to illuminate variable images.

Amongst flat panel displays, the organic electro luminescence displays an image using an organic light emitting diode (OLED) which generates light by means of the recombination of electrons and holes.

Such an organic electro luminescence display has an advantage because the display has an excellent reproducibility and thickness, and therefore the use of organic electro luminescence display device has widely spread in application fields such as PDA, MP3, DSC, etc., as well as in mobile phones.

The power consumption of the organic electro luminescence display is increased however, when a bright light is emitted because the organic electro luminescence display emits light according to the change in electric current capacity, and therefore a low power consumption is necessarily required for applications in various displays.

In order to reduce a power consumption in organic electro luminescence displays in which the light emission level is varied according to the change in electric current capacity, a driving voltage of an image display device should be simply collectively reduced, but when the brightness is lowered in an undesired region of the image, a deterioration in the quality of the picture occurs.

Also, visibility of an image, displayed in a portable display device which is one of the representative application fields of the organic electro luminescence display, may be varied by the surrounding environment such as ambient illumination intensity, etc. since the portable display device is exposed to various differing environments. In particular, visibility of the image, displayed in the portable display device using solar light, may be severely reduced if the ambient illumination intensity is greatly brighter than the brightness of the image.

Therefore, an organic electro luminescence display which may improve visibility to correspond to the surrounding environment should be developed.

SUMMARY OF THE INVENTION

Accordingly, the present invention is designed to solve these and other drawbacks of the prior art, and therefore an object of the present invention is to provide a control unit capable of reducing a power consumption and/or improving an outdoor, and an organic electro luminescence display including the control unit in order to meet the demands of users.

It is therefore, objects of the present invention to provide improved organic electro luminescent display devices, and improved processes for driving organic electro luminescent display devices.

It is another object to provide electro luminescent display devices and processes for driving organic electro luminescent display devices, able to compensate for the surrounding environment.

It is still another object to provide electro luminescent display devices and processes for driving organic electro luminescent display devices, that adjust visibility of the visual images displayed in correspondence with environment of the device.

The first aspect of the present invention may be achieved by providing an organic electro luminescence display, including a pixel unit constructed with a plurality of scan lines coupled to supply scan signals, a plurality of data lines coupled to supply data signals, and a plurality of pixels connected to the scan lines and the data lines, respectively. A scan driver sequentially generates the scan signals and applies the scan signals generated to the plurality of the scan lines. A data driver generates data signals and applies the data signals generated to the data lines. A photo sensor generates a photo sensor signal corresponding to the intensity of the ambient light and an image determination unit makes an estimate of whether the image generated in correspondence with the data signal is a moving image or a still image, and based upon that estimate, generates an image determination signal. A first signal processor selects a gamma value corresponding to the brightness of the ambient light sensed by the photo sensor and applies a gamma correction signal corresponding to the selected gamma value to control a grey level voltage of the data signals. A second signal processor compares a previously set reference value with the photo sensors signal to generate a selection signal and generates data (R',G',B' data) in which input image data (RGB Data) is varied in order to correspond to the selection signal, varies a change range of the changing R',G',B' data to correspond to the image determination signal, and supplies the varied change range of the changing R',G',B' data to the data driver.

The second aspect of the present invention is achieved by providing a method for driving an organic electro luminescence display, by, in Step 1, making an estimate of whether the input image is a moving image or a still image; and in Step 2, changing a data value of the input image data to correspond to intensity of the ambient light and determining a change range according to the estimate made of whether the input image is a moving image or a still image.

BRIEF DESCRIPTION OF THE DRAWINGS

A more complete appreciation of the invention and many of the attendant advantages thereof, will be readily apparent as the same becomes better understood by reference to the following detailed description when considered in conjunction with the accompanying drawings in which like reference symbols indicate the same or similar components, wherein:

FIG. 7A through FIG. 7D are block diagrams illustrating that desired saturation data in every subpixel is calculated by the first operator unit using a saturation variable matrix as indicated by the circuit illustrated in FIG. 6.

DETAILED DESCRIPTION OF THE INVENTION

Figure 1:
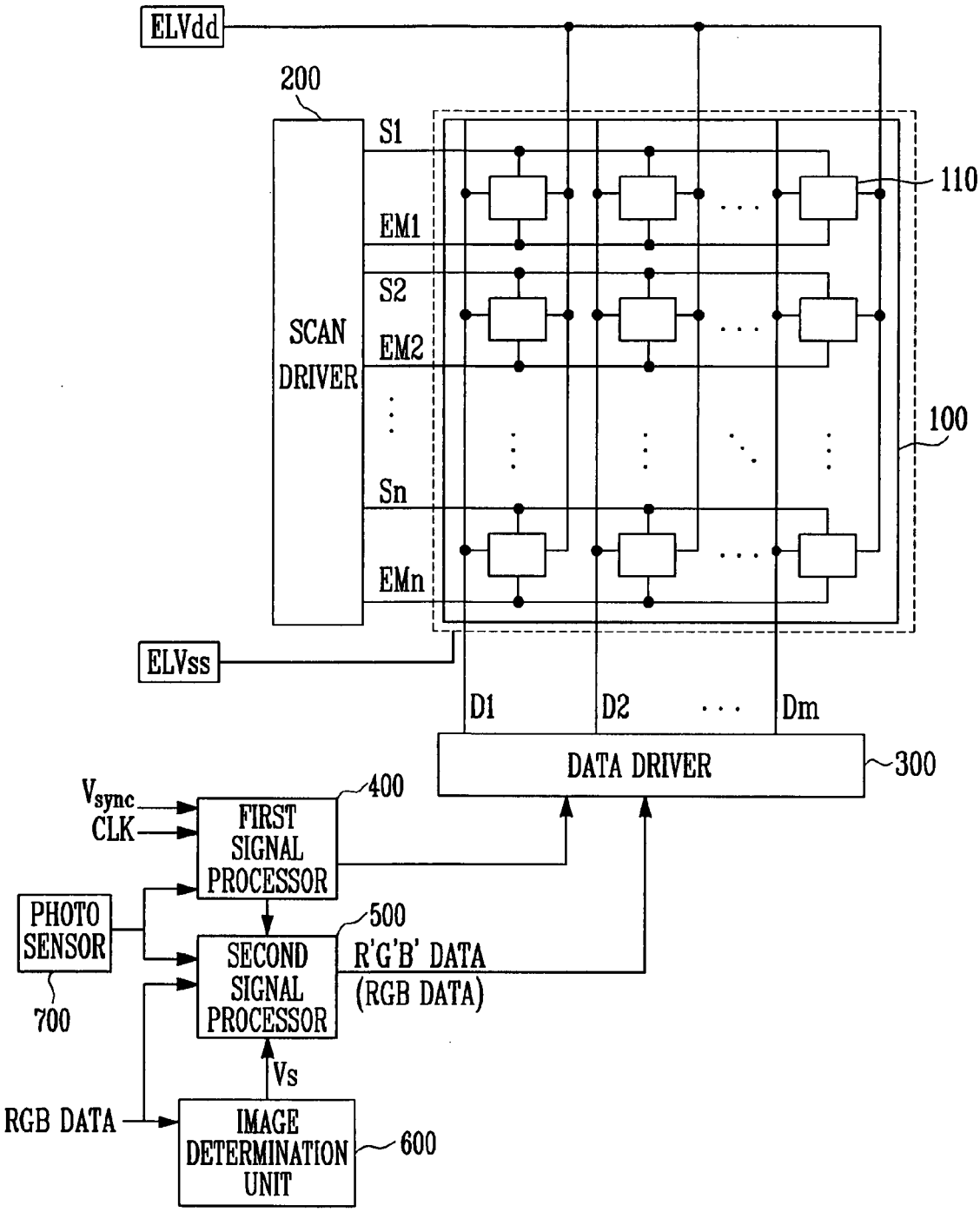
FIG. 1 is a block diagram illustrating a configuration of an organic electro luminescence display according to one embodiment of the present invention.

Hereinafter, preferable embodiments according to the present invention will be described with reference to the accompanying drawings. Here, when one element is connected to another element, one element may not only be directly connected to another element but may also be indirectly connected to another element via an intermediate element. Further, immaterial elements are omitted for clarity. Also, like reference numerals refer to like elements throughout.

FIG. 1 is a block diagram illustrating a configuration of an organic electro luminescence display according to one embodiment of the present invention.

Referring to FIG. 1, the organic electro luminescence display according to one embodiment of the present invention includes a pixel unit 100, a scan driver 200, a data driver 300, a first signal processor 400, a second signal processor 500, an image determination unit 600 and an photo sensor 700.

Pixel unit 100 includes a plurality of pixels 110 connected to the scan lines (S1 to Sn) and the data lines (D1 to Dm). Here, one pixel 110 has one organic light emitting diode and may be composed of at least two subpixels for emitting different color light.

Such a pixel unit 100 displays an image to correspond to first power source (ELVdd) and second power source (ELVss) supplied from the outside; the scan signal supplied from scan driver 200; and the data signal supplied from data driver 300.

Scan driver 200 generates a scan signal and an emission control signal. The scan signal and the emission control signal generated in scan driver 200 is sequentially supplied to the scan lines (S1 to Sn) and the emission lines (EM1 to Emn).

Data driver 300 receives an image data converted by second signal processor 500 and generates a data signal corresponding to the received image data. The data signal generated in data driver 300 is supplied to pixels 110 through the data lines (D1 to Dm) to synchronize with the scan signal.

First signal processor 400 generates a sensor signal to correspond to brightness of the ambient light sensed from photo sensor 700, selects a gamma value according to the sensor signal, and outputs the gamma correction signal corresponding to the selected gamma value to control a grey level voltage of the data signal, thereby to control brightness of pixel unit 100.

Second signal processor 500 compares the previously set reference value with a photo sensor signal (Ssens) inputted from photo sensor 700 to generate a selection signal for selecting at least one of two modes and determines whether or not an input image data (RGB Data) is changed according to the generated selection signal.

Also, second signal processor 500 generates a changing data (R'G'B' Data) for changing a luminance and/or saturation value of the inputted image data (RGB Data) using the image determination signal (Vs) inputted from image determination unit 600, and storing the changed luminance and/or saturation value. That is to say, second signal processor 500 generates a changing data (R'G'B' Data) corresponding to each of a moving image and a still image to correspond to the image determination signal if an image is a moving image or a still image, and the changing data (R'G'B' Data) or the inputted image data (RGB Data) stored in second signal processor 500 is inputted to data driver 300.

Second signal processor 500 generates a changing data (R'G'B' Data) whose saturation for the input image data (RGB Data) is increased to improve visibility. Also, when the changing data (R'G'B' Data) is generated, second signal processor 500 is in more various responses to the displayed image by generating a changing data (R'G'B' Data) for changing the input image data (RGB Data) depending on that the displayed image is a still image or a moving image.

Image determination unit 600 estimates whether the inputted video data is a still image or a moving image, generates an image determination signal (Vs), and supplies the generated image determination signal (Vs) to second signal processor 500. As the method for estimating that the input video data is a still image or a moving image, image determination unit 600 may use a difference between a video data inputted to one frame and a video data inputted to the next frame so as to estimate whether the input video data is a still image or a moving image, and then analyzes a video data so that it is encoded whether the video data itself is a still image or a moving image, thereby estimating whether the video data itself is a still image or a moving image.

Figure 2:
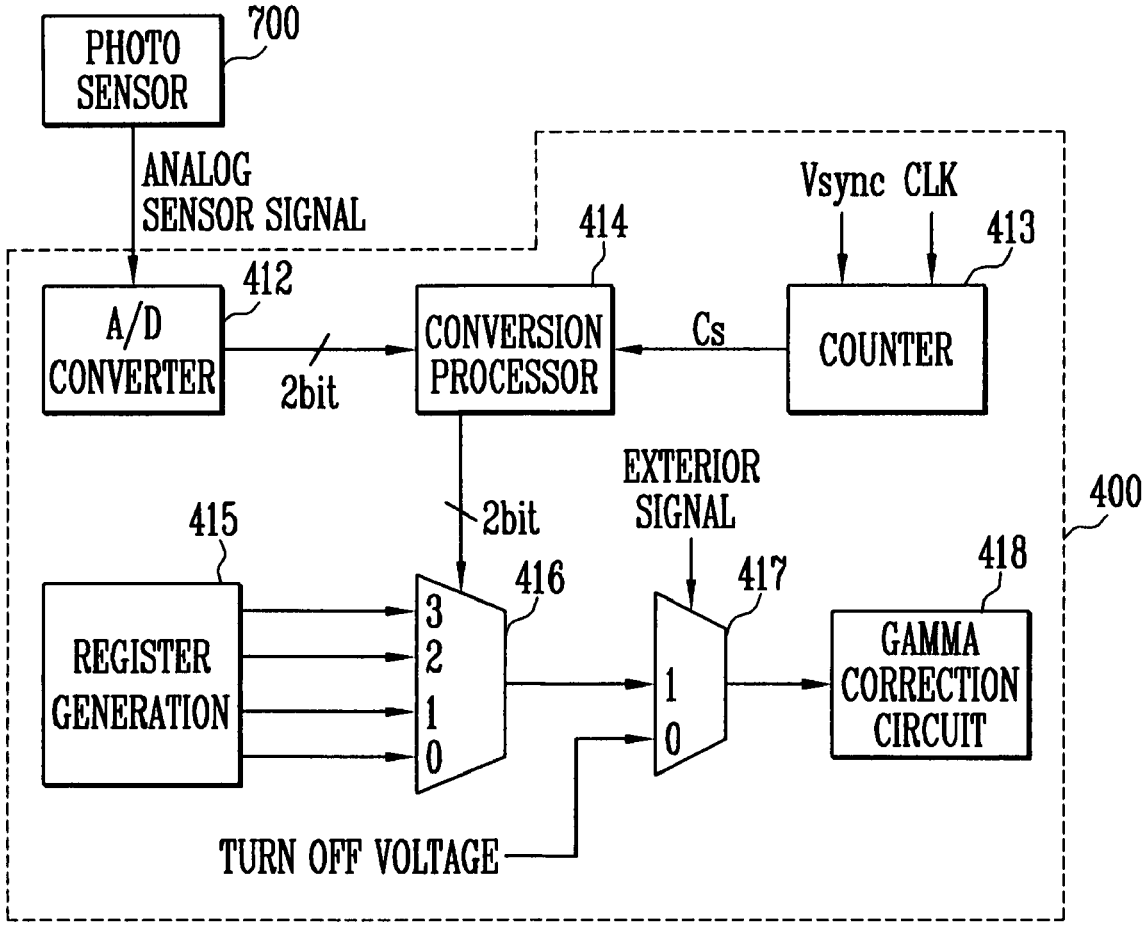
FIG. 2 is a block diagram illustrating one embodiment of a first signal processor as shown in FIG. 1.

FIG. 2 is a block diagram illustrating one embodiment of a first signal processor as shown in FIG. 1. Referring to FIG. 2, first signal processor 400 includes an A/D converter 412, a counter 413, a conversion processor 414, a register generation unit 415, a first selection unit 416, a second selection unit 417 and a gamma correction circuit 418.

A/D converter 412 compares an analog sensor signal outputted from photo sensor 700 with a set reference voltage, and outputs a digital sensor signal corresponding to the analog sensor signal. For example, A/D converter 412 outputs a sensor signal of '11' in the brightest brightness level of the ambient light and outputs a sensor signal of '10' in the rather bright brightness level of the ambient light. Also, A/D converter 412 outputs a sensor signal of '01' in the rather dark brightness level of the ambient light and outputs a sensor signal of '00' in the darkest brightness level of the ambient light.

Counter 413 counts a predetermined number during a certain period by means of a vertical synchronizing signal (Vsync) supplied from the outside, and outputs a counting signal (Cp) corresponding to the predetermined number. For example, if counter 213 uses a binary numeral value of 2 bits, counter 320 is reset to a sensor signal of '00' when the vertical synchronizing signal (Vsync) is inputted, and then counts the number to a sensor signal of '11' by sequentially shifting a clock (CLK) signal. And, if a vertical synchronizing signal (Vsync) is inputted to counter 320 again, then counter 320 is re-set to a reset state. Counter 320 sequentially counts the number from '00' to '11' during one frame period in this manner. And, counter 153 outputs a counting signal (Cp), corresponding to the counted number, to conversion processor 414.

Conversion processor 414 uses the counting signal (Cs) outputted from counter 413 and the sensor signal outputted from A/D converter 412 to output a control signal which selects a set value of each of the registers. That is to say, conversion processor 414 outputs the control signal corresponding to the sensor signal selected when counter 413 outputs the predetermined signal, and sustains the control signal outputted during one frame period by means of the counter. And, if the next frame is selected, then conversion processor 414 resets the outputted control signal, and outputs a control signal corresponding to the sensor signal outputted from A/D converter 412 again, thereby to sustain the control signal during one frame period. For example, conversion processor 414 outputs the control signal corresponding to a sensor signal of '11' and sustains the control signal during the one frame period when counter 413 counts the number if the ambient light is in the brightest state, while conversion processor 414 outputs the control signal corresponding to a sensor signal of '00' and sustains the control signal during the one frame period when counter 413 counts the number if the ambient light is in the darkest state. Also, conversion processor 414 outputs the control signals corresponding to sensor signals of '10' and '01' and sustains the control signal, respectively, in the same manner as described above, if the ambient light is in a rather bright or dark state.

Register generation unit 415 divides a brightness of the ambient light into a plurality of brightness levels, and stores a plurality of register set values to correspond to each of the brightness levels.

First selection unit 416 selects a register set value corresponding to the control signal, set by conversion processor 414, out of a plurality of register set values stored in register generation unit 415.

Second selection unit 417 receives a 1-bit set value for controlling an ON/OFF state from the outside. At this time, first signal processor 400 is operated if an exterior signal of '1' is selected, and first signal processor is turned off if an exterior signal of '0' is selected, and therefore second selection unit 417 electively controls the brightness according to the ambient light.

Gamma correction circuit 418 generates a plurality of gamma correction signals corresponding to the register set value selected according to the control signal set by conversion processor 414. At this time, the control signal corresponds to the sensor signal from photo sensor 700, and therefore the gamma correction signal has different values according to the brightness of the ambient light. In the case of the above operation, the gamma correction signals are generated in every R,G,B group.

Figure 3:
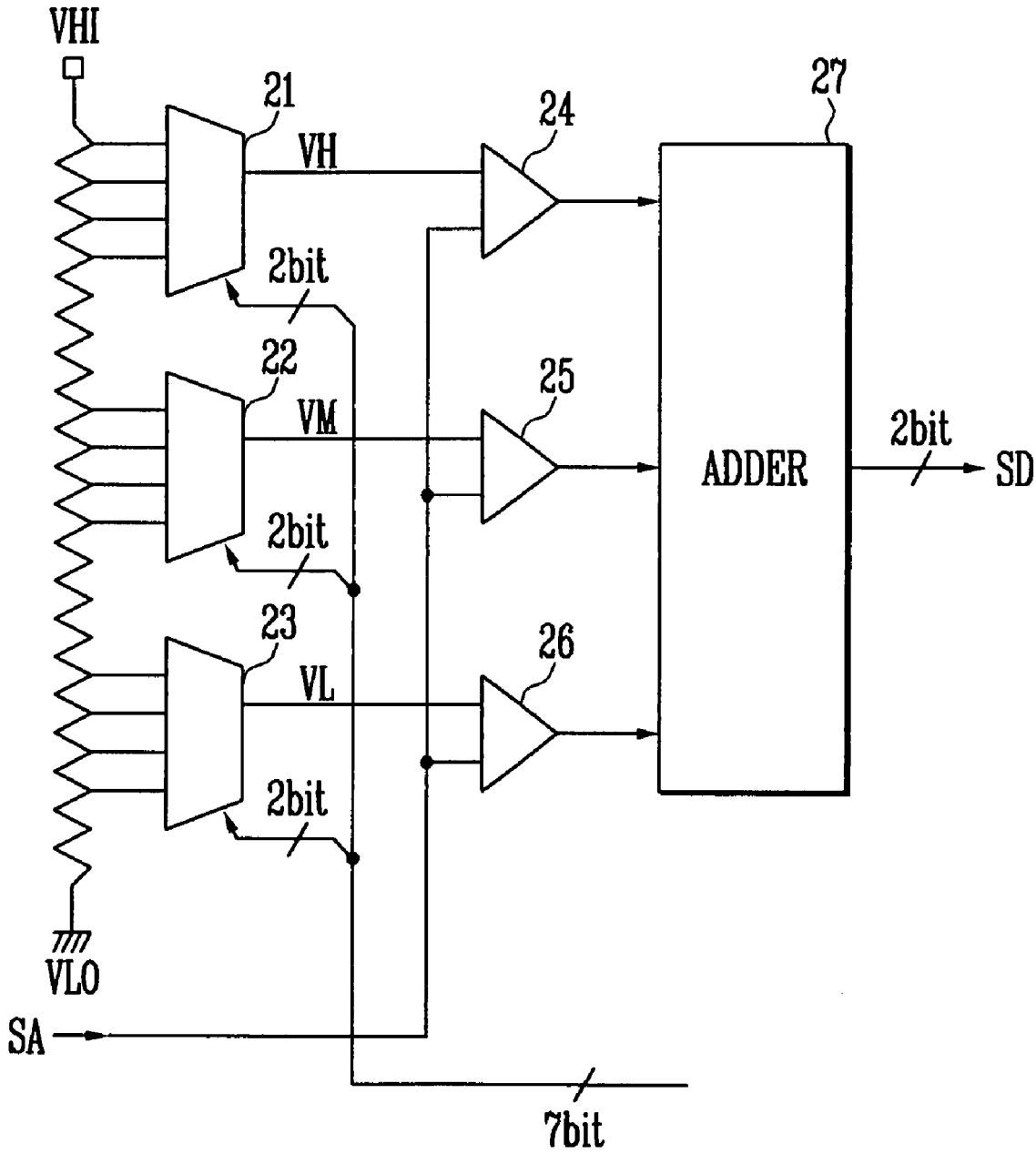
FIG. 3 is a block diagram illustrating one embodiment of an A/D converter in accordance with the illustration in FIG. 2.

FIG. 3 is a block diagram illustrating one embodiment of an A/D converter as shown in FIG. 2. Referring to FIG. 3, A/D converter 412 includes first to third selectors 21, 22, 23, first to third comparators 24, 25, 26 and an adder 27.

First to third selectors 21, 22, 23 receive a plurality of grey level voltages distributed through a plurality of resistor arrays for generating a plurality of grey level voltages (VHI to VLO), and output grey level voltages corresponding to a set value of differently set 2 bits, and then assigns the grey level voltages to reference voltages (VH to VL).

First comparator 24 compares the first reference voltage (VH) with an analog sensor signal (SA), and then outputs the comparison results. For example, first comparator 24 outputs a sensor signal of '1' if the analog sensor signal (SA) is greater than the first reference voltage (VH), and outputs a sensor signal of '0' if the analog sensor signal (SA) is lower than the first reference voltage (VH).

In the manner as described above, second comparator 25 compares the second reference voltage (VM) with an analog sensor signal (SA), and then outputs the comparison results, and third comparator 26 compares the third reference voltage (VM) with an analog sensor signal (SA), and then outputs the comparison results. Also, a region of the analog sensor signal (SA) corresponding to the same digital sensor signal (SD) may also be changed by varying the first to third reference voltages (VH to VL).

Adder 27 adds all of the resulting values from first to third comparators 24 to 26 and outputs the added values to a 2-bit digital sensor signal (SD).

A/D converter as shown in FIG. 3 is described in detail, as follows, on the assumption that the first reference voltage (VH) is set to 1V, the second reference voltage (VM) is set to 2V, the third reference voltage (VL) is set to 3V, and a voltage value of the analog sensor signal (SA) is increased as the ambient light becomes brighter. If the analog sensor signal (SA) is lower than 1V, then first to third comparators 24 to 26 output sensor signals of '0', '0' and '0', respectively, and therefore adder 27 outputs a digital sensor signal (SD) of '00'. If the analog sensor signal (SA) is set between 1V and 2V, then first to third comparators 24 to 26 output sensor signals of '1', '0' and '0', respectively, and therefore adder 27 outputs a digital sensor signal (SD) of '01'. In the manner as described above, adder 27 outputs a digital sensor signal (SD) of '10' if the analog sensor signal (SA) is set between 2V and 3V, and adder 27 outputs a digital sensor signal (SD) of '11' if the analog sensor signal (SA) is greater than 3V. A/D converter 212 is operated in the manner as described above to divide the ambient light into four brightness levels. At this time, the A/D converter outputs a sensor signal of '00' in the darkest brightness level, a sensor signal of '01' in a rather dark brightness level, a sensor signal of '10' in a rather bright brightness level, and a sensor signal of '11' in the brightest brightness level.

Figure 4:
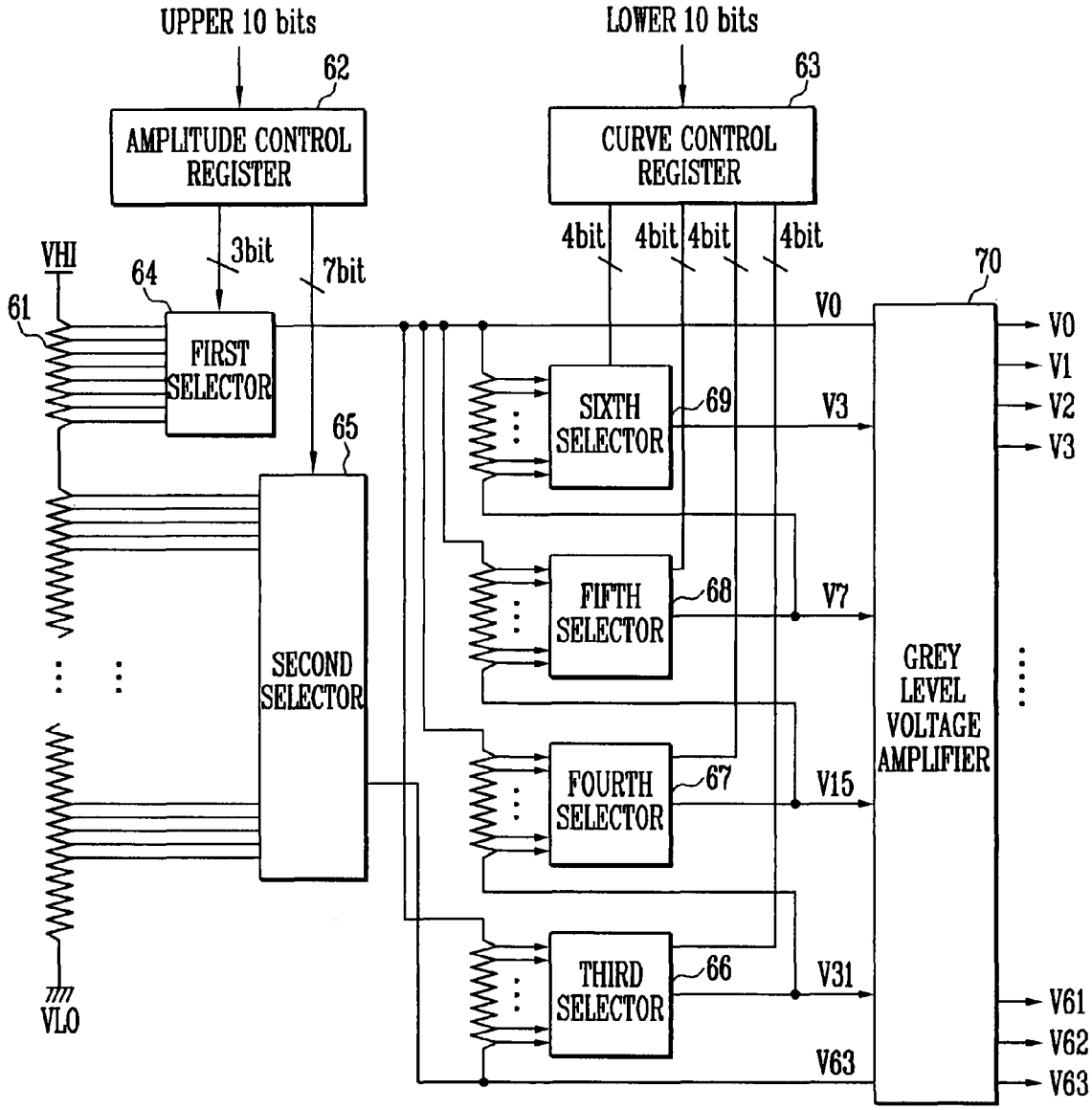
FIG. 4 is a block diagram illustrating one embodiment of a gamma correction circuit as shown in FIG. 2.

FIG. 4 is a block diagram illustrating one embodiment of a gamma correction circuit as shown in FIG. 2. Referring to FIG. 4, the gamma correction circuit includes a ladder resistor 61, an amplitude control register 62, a curve control register 63, a first selector 64 to a sixth selector 69 and a grey level voltage amplifier 70, all being used for driving the gamma correction circuit.

Ladder resistor 61 sets an uppermost level voltage (VHI), supplied from the outside, to a reference voltage, and a plurality of variable registers included between the lowermost level voltage (VLO) and the reference voltage are connected in series and generates a plurality of grey level voltages by means of ladder resistor 61. Also, if ladder resistor 61 has a low value, then an amplitude control range becomes narrower, but a control precision is improved. On the while, if ladder resistor 61 has a high value, then an amplitude control range becomes wider, but a control precision is deteriorated.

Amplitude control register 62 outputs a 3-bit register set value to first selector 64, and outputs a 7-bit register set value to second selector 65. At this time, the selectable grey level number may be increased by increasing a set bit number, and a grey level voltage may be differently selected by changing a register set value.

Curve control register 63 outputs a 4-bit register set value to third selector 66 to sixth selector 69, respectively. At this time, the register set value may be changed, and the selectable grey level voltage may be controlled according to the register set value.

An upper 10 bits out of the register value generated in register generation unit 215 are inputted to amplitude control register 62, and a lower 16 bits are inputted to curve control register 63, and they are selected as a register set value.

First selector 64 selects a grey level voltage, corresponding to the 3-bit register set value set in amplitude control register 62, from a plurality of the grey level voltages distributed through ladder resistor 61, and outputs the selected grey level voltage as the uppermost grey level voltage.

Second selector 65 selects a grey level voltage, corresponding to the 7-bit register set value set in amplitude control register 62, from a plurality of the grey level voltages distributed through ladder resistor 61, and outputs the selected grey level voltage as the lowermost grey level voltage.

Third selector 66 distributes a voltage between the grey level voltage from first selector 64 and the grey level voltage outputted from second selector 65 to a plurality of the grey level voltages through a plurality of the resistor arrays, and selects and outputs a grey level voltage corresponding to the 4-bit register set value.

Fourth selector 67 distributes a voltage between the grey level voltage outputted from first selector 64 and the grey level voltage from third selector 66 through a plurality of the resistor arrays, and selects and outputs a grey level voltage corresponding to the 4-bit register set value.

Fifth selector 35 selects a grey level voltage corresponding to the 4-bit register set value from the grey level voltage between first selector 31 and fourth selector 34, and outputs the selected grey level voltage.

Sixth selector 36 selects a grey level voltage corresponding to the 4-bit register set value from a plurality of the grey level voltages between first selector 31 and fifth selector 35, and outputs the selected grey level voltage. In the operation as described above, gamma characteristics may easily be controlled according to the characteristics of the organic light emitting diode since a curve of an intermediate grey level portion may be controlled according to the register set value of curve control register 63. Also, a resistance value of each of ladder resistors 61 is set so that an electric potential difference between the grey levels can become higher as it is displayed with a low grey level so as to bulge the gamma curve characteristics downwards, while a resistance value of each of ladder resistors 61 is set so that an electric potential difference between the grey levels can become smaller as it is displayed with a low grey level so as to bulge the gamma curve characteristics upwards.

Grey level voltage amplifier 37 outputs a plurality of the grey level voltages corresponding to each of a plurality of the grey levels which may be displayed in pixel unit 100. FIG. 5 shows the output of the grey level voltage corresponding to 64 grey levels.

In the above-mentioned operation, the amplitude and the curve may be differently set in R, G and B groups by means of curve control register 63 and amplitude control register 62 by installing a gamma correction circuit in the R, G and B groups so as to obtain a substantially identical luminance characteristic in consideration of the changes in the characteristics of the R, G and B groups.

Figure 5A:
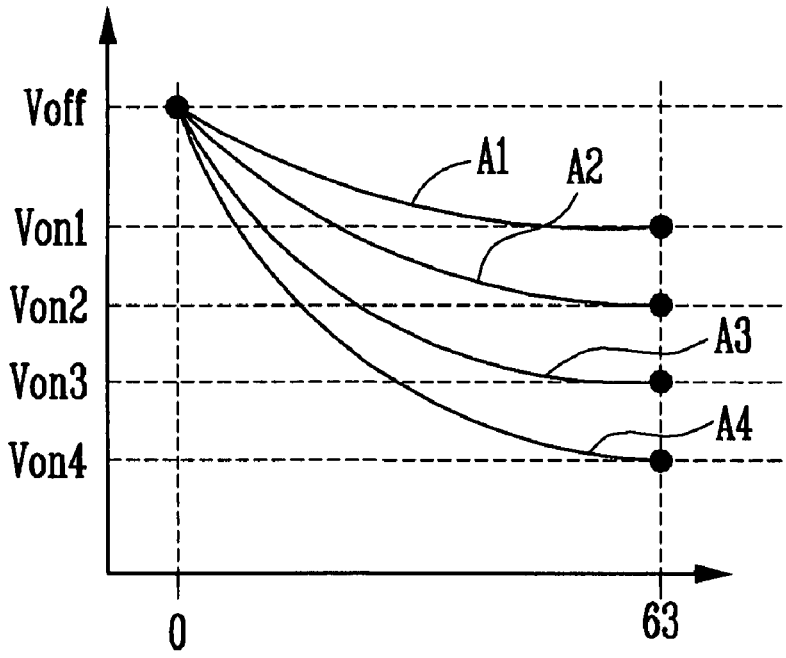
FIG. 5A and FIG. 5B are block diagrams illustrating a gamma curve according to the gamma correction circuit as shown in FIG. 4.
Figure 5B:
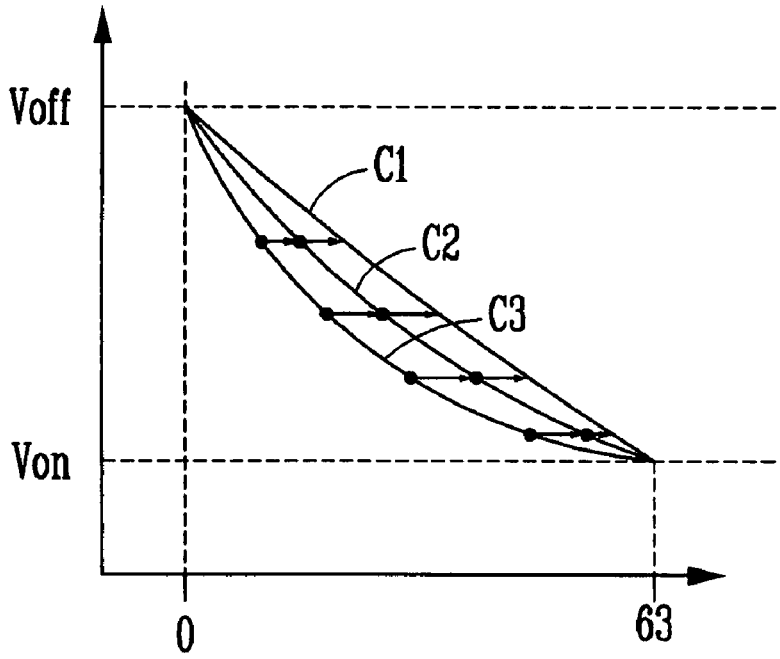

FIG. 5A and FIG. 5B are block diagrams illustrating a gamma curve according to the gamma correction circuit as shown in FIG. 4.

FIG. 5A shows that amplitude of a lower grey level voltage may be controlled by changing the lower grey level voltage according to a 7-bit register set value set in amplitude control register 62 without changing an upper-level grey level voltage. Reference numeral A1 represents a gamma curve corresponding to the sensor signal in the brightest brightness level of the ambient light, and reference numeral A2 represents a gamma curve corresponding to the sensor signal in the darkest brightness level of the ambient light.

Also, reference numeral A3 represents a gamma curve corresponding to the sensor signal in a rather bright brightness level of the ambient light, and reference numeral A4 represents a gamma curve corresponding to the sensor signal in a rather dark brightness level of the ambient light. At this time, if an amplitude voltage of the grey level voltage is adjusted to a small voltage range, then the second selector is set to select the highest level voltage by controlling the register set value of amplitude control register 62. Also, if an amplitude voltage of the grey level voltage is adjusted to a large voltage range, then the second selector is set to select the lowest level voltage.

FIG. 5B shows that a gamma curve is controlled by changing only an intermediate grey level voltage without changing an upper grey level voltage and a lower grey level voltage according to the register set value set in curve control register 63. Curve control register 63 inputs a 4-bit register set value to a third selector 33 to a sixth selector 36, respectively, and generates a gamma curve by selecting four gamma values corresponding to the register set value. An OFF voltage (Voff) is a voltage corresponding to a black grey level (grey level value 0), and an ON voltage (Von) is a voltage corresponding to a white grey level (grey level value 63). An inclination of a reference numeral C2 curve is changed in a larger range than an inclination of a curve corresponding to a C1 curve, and changed in a lower range than an inclination of a C3 curve. From FIG. 6*a* and FIG. 6*b*, it is revealed that, if a set value of the gamma control register is changed, then the grey level voltage is changed to form a gamma curve, and therefore it is possible to control brightness of each of pixels 110 in pixel unit 100.

Figure 6:
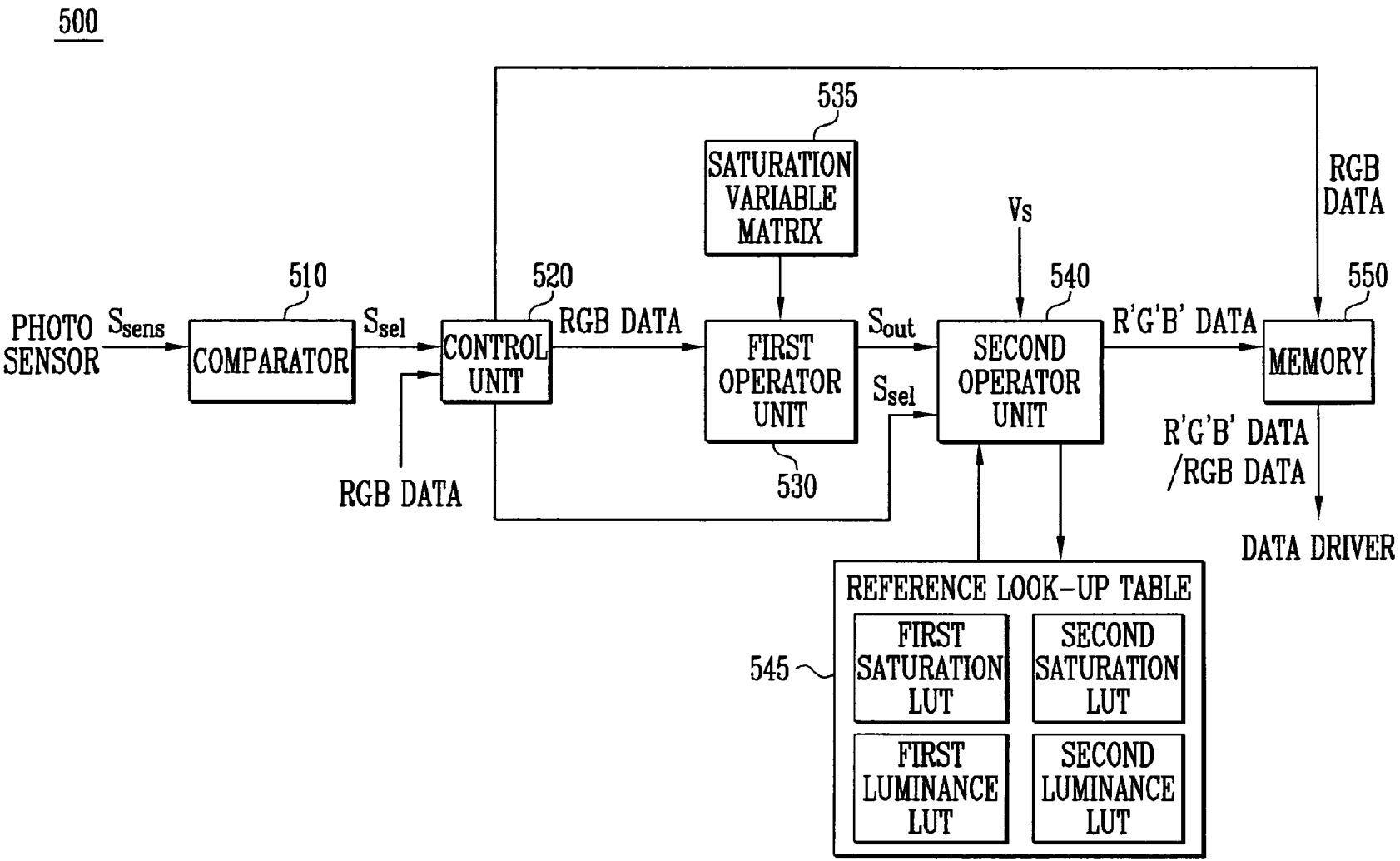
FIG. 6 is a block diagram illustrating one embodiment of a second signal processor as shown in FIG. 1.

FIG. 6 is a block diagram illustrating one embodiment of a second signal processor as shown in FIG. 1. Referring to FIG. 6, second signal processor 500 includes a comparator 510, a control unit 520, a first operator unit 530, a saturation variable matrix 535, a second operator unit 540, a reference look-up table unit 545 and a memory 550.

Comparator 510 compares a previously set reference value with an photo sensor signal (Ssens) supplied from photo sensor 700 and outputs a selection signal (Ssel) for selecting at least one of two modes.

More particularly, comparator 510 sets at least two modes on the basis of the previously set reference value to correspond to the size of the photo sensor signal (Ssens), and outputs a selection signal (Ssel) corresponding to the two modes. Hereinafter, assume that comparator 510 sets two modes to correspond to the photo sensor signal (Ssens) for convenience's sake.

For example, if the photo sensor signal (Ssens) belongs to the minimum range out of the previously set reference value, that is, the weakest range in intensity of the ambient light, comparator 510 is set to a first mode so that it can not change the input image data (RGB Data), and outputs a selection signal (Ssel) corresponding to the first mode.

And, if the photo sensor signal (Ssens) belongs to the largest range out of the previously set reference value, that is, if intensity of the ambient light belongs to the most intensive range as in case the solar light is directly incident, then comparator 510 is set to a second mode for controlling saturation and/or luminance of the input image data (RGB Data) to be changed maximally, and may output a selection signal (Ssel) corresponding to the second mode.

The selection signal (Ssel) outputted from comparator 510 is inputted to control unit 520.

However, in the case of the embodiment of the present invention, it is characterized in that first signal processor 400 is operated if an illumination intensity is less than the previously set reference value according to the brightness levels of the ambient light sensed in photo sensor 700, while second signal processor 500 is operated if the illumination intensity is greater than the reference value, and therefore second signal processor 500 is preferably operated in the second mode.

Control unit 520 determines whether or not the input image data (RGB Data) is changed to correspond to the selection signal (Ssel) from comparator 510.

Such a control unit 520 transmits the input image data (RGB Data) to first operator unit 530, or stores the input image data (RGB Data) in memory 550, depending on whether or not the determined input image data (RGB Data) is changed.

For example, control unit 520 stores the input image data (RGB Data) in memory 550 if the intensity of the ambient light has the weakest signal out of the selection signal (Ssel), namely, if the selection signal (Ssel) corresponding to the first mode is supplied.

And, in the other case, that is, if the selection signal (Ssel) selected in the second mode is suppled, control unit 520 transmits the input image data (RGB Data) to first operator unit 530, while transmitting the selection signal (Ssel), inputted to control unit 520 itself, to second operator unit 540.

First operator unit 530 refers to saturation variable matrix 535 to generate a pixel saturation data (Sout) corresponding to input image data (RGB Data) transmitted from control unit 520.

For example, first operator unit 530 may carry out an operation on the input data (Rin, Gin, Bin) and saturation variable matrix 535 in each of the subpixels which is included in the input image data (RGB Data) to calculate a desired saturation data (Rs, Gs, Bs) in every subpixel, and may use the calculated saturation data (Rs, Gs, Bs) to generate a pixel saturation data (Sout).

Here, saturation variable matrix 535 may be used to calculate the desired saturation data (Rs, Gs, Bs) in every subpixel. A method for calculating a desired saturation data (Rs, Gs, Bs) in every subpixel will be described later as shown in FIGS. 7A-7D.

The pixel saturation data (Sout) is calculated from the desired saturation data (Rs, Gs, Bs) in every subpixel. For example, pixel saturation data (Sout) may be set to the maximum value out of the desired saturation data (Rs, Gs, Bs) in every subpixel, or set to a predetermined value corresponding to a difference between the maximum value and the minimum value of the desired saturation data (Rs, Gs, Bs) in every subpixel.

The pixel saturation data (Sout) generated in first operator unit 530 is supplied to second operator unit 540.

Second operator unit 540 extracts a changing data (R'G'B' Data) corresponding to the still image or the moving image from reference look-up table unit 545 to correspond respectively to pixel saturation data (Sout), selection signal (Ssel), image determination signal (Vs) supplied respectively from first operator unit 530, control unit 520 and image determination unit 600, and stores the extracted changing data (R'G'B' Data) in memory 550.

More particularly, second operator unit 540 selects one of the first saturation and luminance look-up table (LUT) and the second saturation and luminance look-up table in reference look-up table unit 545 to correspond to the image determination signal (Vs). That is to say, second operator unit 540 selects the first saturation and luminance look-up table (LUT) if the displayed image is a moving image, and selects the second saturation and luminance look-up table (LUT) if the displayed image is a still image. And, second operator unit 540 extracts a changing data (R'G'B' Data) from the selected look-up table, the changing data (R'G'B' Data) having the saturation and luminance value corresponding to the pixel saturation data (Sout).

Here, the saturation look-up table and the luminance look-up table means tables referred to extract a saturation change value and a luminance change value which correspond to the pixel saturation data (Sout), respectively.

At this time, the first saturation and luminance look-up table and the second saturation and luminance look-up table store the different saturation and/or luminance values to correspond to the same pixel saturation data (Sout). For example, the first saturation and luminance look-up table, selected if the image determination signal is a still image, is set to have a lower saturation and/or luminance value than the second saturation and luminance look-up table selected if the image determination signal is a moving image.

Memory 550 stores the input image data (RGB Data) transmitted from control unit 520, or the changing data (R'G'B' Data) supplied from second operator unit 540. The input image data (RGB Data) or the changing data (R'G'B' Data) stored in memory 550 is inputted to data driver 300.

FIG. 7A through FIG. 7D inclusive are matrix diagrams showing that a desired saturation data in every subpixel is calculated in the first operator unit using a saturation variable matrix as shown in FIG. 6.

Referring to FIG. 7A through FIG. 7D, first operator unit 530 may calculate the desired saturation data (Rs, Gs, Bs) in every subpixel by multiplying each of the input data (Rin, Gin, Bin) in every subpixel included in the saturation variable matrix (535, A) and the input image data (RGB Data). (FIG. 7A)

Saturation variable matrix 535 (A) is a matrix for controlling a saturation by using a saturation coefficient (k) for determining a saturation control, and it is used to calculate each of the desired saturation data (Rs, Gs, Bs) in every subpixel by changing values of the input data (Rin, Gin, Bin) in every subpixel by means of the previously set saturation coefficient (saturation factor, k).

Such a saturation variable matrix 535 (A) is set in consideration of a white balance of the pixels, and a matrix as shown in FIG. 7B is generally used herein.

That is to say, first operator unit 530 may calculate the desired saturation data (Rs, Gs, Bs) in every subpixel by multiplying the desired saturation data (Rs, Gs, Bs) in every subpixel by multiplying the saturation variable matrix (535, A) and the input data (Rin, Gin, Bin) in every subpixel as is shown in FIG. 7B.

Here, the saturation is increased if the saturation coefficient (k) has a larger value than 1 and decreased if the saturation coefficient (k) has a smaller value than 1. And, if the saturation coefficient (k) has a value of 1, then the saturation is not changed since the saturation variable matrix (535, A) becomes a 3×3 unit matrix as is shown in FIG. 7C.

Also, if the saturation coefficient (k) has a value of 0, then the desired saturation-data (Rs, Gs, Bs) in every subpixel is changed into a saturation-free grey image since the desired saturation data (Rs, Gs, Bs) in every subpixel is set to the same ratio as the white balance, as is shown in FIG. 7D.

The foregoing paragraphs describe an organic electro luminescence display and driving method uses an image determination unit to generate image determination signals indicative of whether images generated in response to data signals are moving images still images, selects a gamma value corresponding to the brightness of the ambient light sensed, applies gamma correction signals corresponding to selected gamma values to control grey level voltages of the data signals, generates a selection signal based on a comparison of a previously set reference value with the photo sensor signal, and generates R',G',B' data to vary an input image RGB data to correspond to the selection signal, varies a change range of the changing R',G',B' data to correspond to the image determination signal, and supplies the varied change range of the changing data (R',G',B' data) to the data driver.

The organic electro luminescence display according to the present invention may be useful to control luminance according to the ambient light, improve visibility and reduce power consumption. Also, the organic electro luminescence display according to the present invention may be useful to improve visibility by changing the input image data in response to surrounding environments such as intensity of the ambient light, and particularly to improve visibility under the strong solar light by generating a changing data for enhancing saturation of the input image data according to the moving image and the still image and displaying an image corresponding to the generated changing data.

The description proposed herein is just a preferable example for the purpose of illustrations only, not intended to limit the scope of the invention, so it should be understood that other equivalents and modifications could be made thereto without departing from the spirit and scope of the invention as apparent to those skilled in the art. Therefore, it should be understood that the present invention might be not defined within the scope of which is described in detailed description but within the scope of which is defined in the claims and their equivalents.

What is claimed is:

1. An organic electro luminescence display, comprising:

a pixel unit including a plurality of scan lines coupled to supply a scan signal, a plurality of data lines coupled to supply a data signal, and a plurality of pixels connected to the scan lines and the data lines, respectively;

a scan driver disposed to sequentially generate scan signals and apply the scan signals generated to a plurality of the scan lines;

a data driver disposed to generate data signals and apply the data signals generated to the data lines;

a photo sensor generating a photo sensor signal corresponding to intensity of light ambient to the display;

an image determination unit disposed to generate an image determination signal based in dependence upon an estimate of whether an image generated in response to the data signals is a moving image or a still image;

a first signal processor selecting a gamma value corresponding to the brightness of the ambient light sensed by the photo sensor and applying a gamma correction signal corresponding to a selected gamma value to control a grey level voltage of the data signals; and a second signal processor comparing a previously set reference value with the photo sensor signal to generate a selection signal and generating image changing data in which an input image data is varied to correspond to the selection signal, varying a change range of the image changing data to correspond to the image determination signal, and supplying the change range of the image changing data varied to the data driver.

2. The organic electro luminescence display according to claim 1, wherein the first signal processor is driven according to brightness levels of the ambient light sensed by the photo sensor if the ambient light has an illumination intensity lower than a previously set reference, and the second signal processor is driven if the ambient light has an illumination intensity greater than the reference value.

3. The organic electro luminescence display according to claim 1, wherein the data driver receives image data converted by at least one control unit from among the first and second signal processors to generate the data signals corresponding to the image data and supplies the data signals generated to the data lines.

4. The organic electro luminescence display according to claim 1, wherein the first signal processor comprises:

an analog/digital converter converting an analog sensor signal received from the photo sensor into a digital sensor signal;

a counter making a count to a predetermined number during one frame period and generating a counting signal corresponding to the predetermined number;

a conversion processor using the digital sensor signal and the counting signal to generate a control signal corresponding to the digital sensor signal and the counting signal;

a register generation unit dividing a representation of brightness of the ambient light into a plurality of brightness levels and storing a plurality of register set values corresponding to each of the brightness levels;

a first selection unit selecting one of a plurality of the register set values stored in the register generation unit to correspond to the control signal set by the conversion processor; and a gamma correction circuit generating a gamma correction signal in conformance with the control signal.

5. The organic electro luminescence display according to claim 4, wherein the first signal processor further comprises a second selection unit controlling an ON/OFF state of the first signal processor.

6. The organic electro luminescence display according to claim 1, wherein the second signal processor comprises:

a comparator generating a selection signal indicative of a selection of one of at least two modes, in dependence upon a comparison between the sensor signal generated in the photo sensor and a previously set reference value;

a control unit making a determination of whether the input image data is changed to correspond to the selection signal;

a first operator unit generating pixel saturation data to correspond to the input image data supplied from the control unit;

a second operator unit extracting changing data to correspond to the pixel saturation data and the selection signal; and a memory storing the input image data supplied from the control unit and the changing data supplied from the second operator unit.

7. The organic electro luminescence display according to claim 6, further comprising a saturation variable matrix accessible by the first operator unit.

8. The organic electro luminescence display according to claim 7, wherein the first operator unit generates pixel saturation data using the saturation data for every subpixel by adding input data in every subpixel included in the input image data and the saturation variable matrix to calculate desired saturation data for every subpixel.

9. The organic electro luminescence display according to claim 6, further comprising a reference look-up table unit addressable by the second operator unit, the reference look-up table comprising a first saturation and luminance look-up table, and a second saturation and luminance look-up table.

10. The organic electro luminescence display according to claim 9, wherein the second operator unit selects one of the first saturation and luminance look-up table and the second saturation and luminance look-up table to correspond to the image determination signal and extracts the changing data from the look-up table selected.

* * * * *